US009702369B2

(12) United States Patent
Lee

(10) Patent No.: US 9,702,369 B2
(45) Date of Patent: Jul. 11, 2017

(54) ELECTRIC FAN WITH IMPEDIMENT BUFFERING

(71) Applicant: Wen Ching Lee, Taichung (TW)

(72) Inventor: Wen Ching Lee, Taichung (TW)

( * ) Notice: Subject to any disclaimer, the term of this patent is extended or adjusted under 35 U.S.C. 154(b) by 325 days.

(21) Appl. No.: 14/305,059

(22) Filed: Jun. 16, 2014

(65) Prior Publication Data

US 2014/0369835 A1 Dec. 18, 2014

(30) Foreign Application Priority Data

Jun. 17, 2013 (CN) ..... 2013 2 0346362 U

(51) Int. Cl.
*F04D 25/10* (2006.01)
*F04D 19/00* (2006.01)
*F04D 25/16* (2006.01)

(52) U.S. Cl.
CPC ..... *F04D 25/105* (2013.01); *F04D 19/007* (2013.01); *F04D 25/166* (2013.01)

(58) Field of Classification Search
None
See application file for complete search history.

(56) References Cited

U.S. PATENT DOCUMENTS 2,746,673 A * 5/1956 Collins ..... F04D 25/105 74/411.5
5,800,126 A * 9/1998 Tsai ..... F04D 25/105 416/100
6,468,036 B1 * 10/2002 Song ..... F01D 7/00 416/100
6,537,029 B1 * 3/2003 Chen-Lung ..... F04D 29/601 416/169 R
8,167,542 B1 * 5/2012 Owusu ..... F04D 17/04 415/127
2011/0008190 A1 * 1/2011 Lee ..... F04D 25/084 417/410.1

* cited by examiner

*Primary Examiner* — Nathaniel Wiehe
*Assistant Examiner* — Georgi Korobanov
(74) *Attorney, Agent, or Firm* — Rosenberg, Klein & Lee

(57) ABSTRACT

An electric fan includes a fan body having a fan shaft coupled to a fan motor. A fan motor bracket is connected to a fixing portion of the fan motor. A swivel shaft is coupled to the fan motor bracket. A sleeve is mounted around the swivel shaft and is coupled to an output shaft of a swivel motor. The sleeve includes an inner periphery having grooves. The swivel shaft receives an elastic element extending in a radial direction of the swivel shaft. A ball is mounted to an end of the elastic element. The ball is biased by the elastic element to be partially received in one of the grooves. If the fan body is impeded during the swiveling movement, the ball moves inward and compress the elastic element, disengaging the swivel shaft from the sleeve to reduce damage to the sleeve and the output shaft of the motor.

3 Claims, 8 Drawing Sheets

ELECTRIC FAN WITH IMPEDIMENT BUFFERING

BACKGROUND OF THE INVENTION

The present invention relates to an electric fan and, more particularly, to an electric fan with impediment buffering.

An electric fan generally includes a fan motor to drive blades to rotate for providing a cooling effect through provision of air disturbance. Although air conditioners are widely used, electric fans are still an option for many families, offices, public areas, or even industries in consideration of economics and energy saving purposes.

An electric fan general includes various basic switches including an on-off switch for turning the electric fan on or off and a speed selection mechanism allowing control of the rotating speed of the fan motor to adjust the wind output.

Furthermore, a swivel motor for driving a motor base to rotate can be provided. The swivel motor drives a shaft to rotate the fan motor and the head of the electric fan, such that the fan motor and the head of the electric fan swivel in a limited angle, providing a wider area of the outputted wind.

However, the head of the electric fan could be impeded by an external force or an alien object. For example, the head of the electric fan could be inadvertently touched by the user or impeded by an alien object or a corner, such that the swivel motor cannot smoothly transmit the kinetic energy, leading to damage to the swivel motor.

BRIEF SUMMARY OF THE INVENTION

In view of the above technical problems, the present invention provides an electric fan with impediment buffering. The electric fan includes a fan body having a plurality of blades coupled to a fan shaft. The fan shaft is coupled to a fan motor. The fan body further includes a fan motor bracket connected to a fixing portion of the fan motor. An impediment buffering device includes a swivel shaft coupled to the fan motor bracket and a sleeve mounted around the swivel shaft. The sleeve is coupled to an output shaft of a swivel motor. The sleeve includes an inner periphery having a plurality of grooves. The swivel shaft receives an elastic element extending in a radial direction of the swivel shaft. A ball is mounted to an end of the elastic element. The ball is biased by the elastic element to be partially received in one of the plurality of grooves.

In an example, a support is fixed in relation to the swivel shaft. The support includes a bearing cap receiving a ball bearing. An electrically conductive copper ring is mounted around the swivel shaft. A tube is mounted to the support and extends in a radial direction. An electrically conductive spring is received in the tube. An electrically conductive bead is attached to an end of the electrically conductive spring facing the electrically conductive copper ring. When the electrically conductive copper ring rotates, the electrically conductive bead is biased by the electrically conductive spring to contact the electrically conductive copper ring, allowing 360° rotation of the electrically conductive copper ring. The electrically conductive spring is adapted to be connected to a power source.

The present invention will become clearer in light of the following detailed description of illustrative embodiments of this invention described in connection with the drawings.

DETAILED DESCRIPTION OF THE INVENTION

Figure 1:
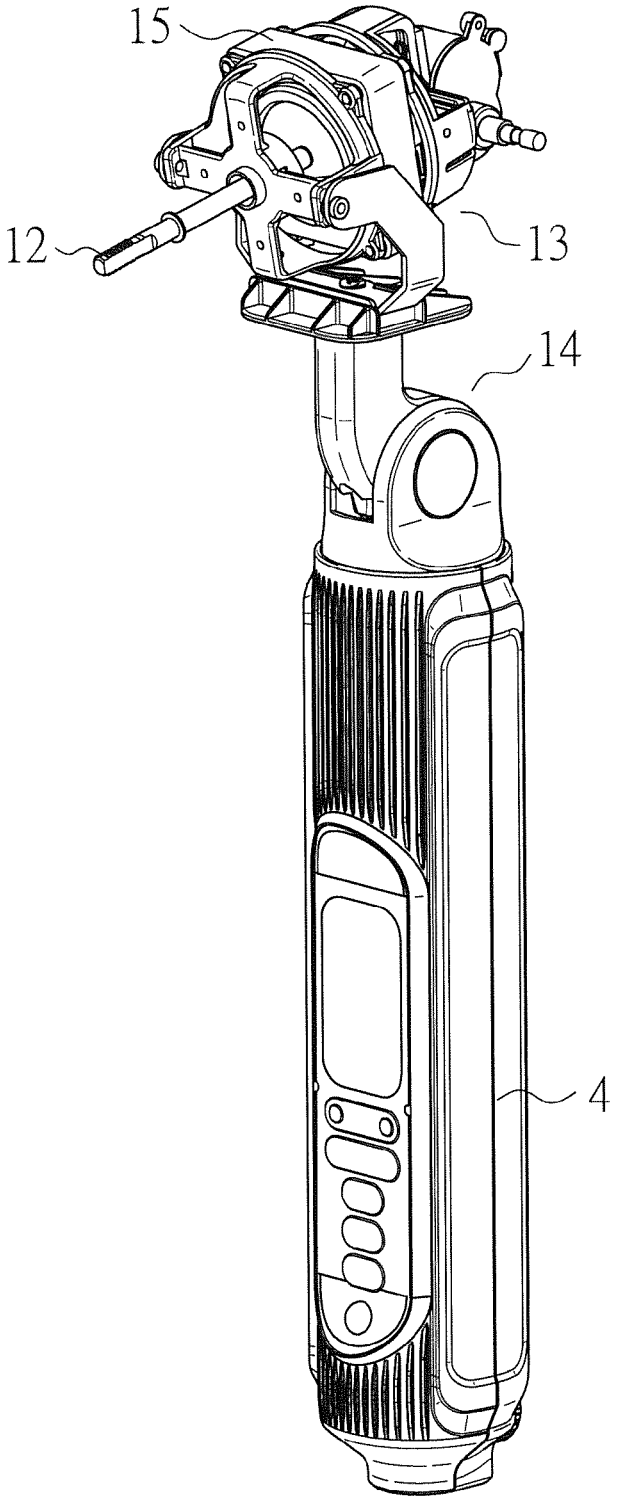
FIG. 1 is a perspective view of an electric fan according to the present invention, with a fan removed.
Figure 5:
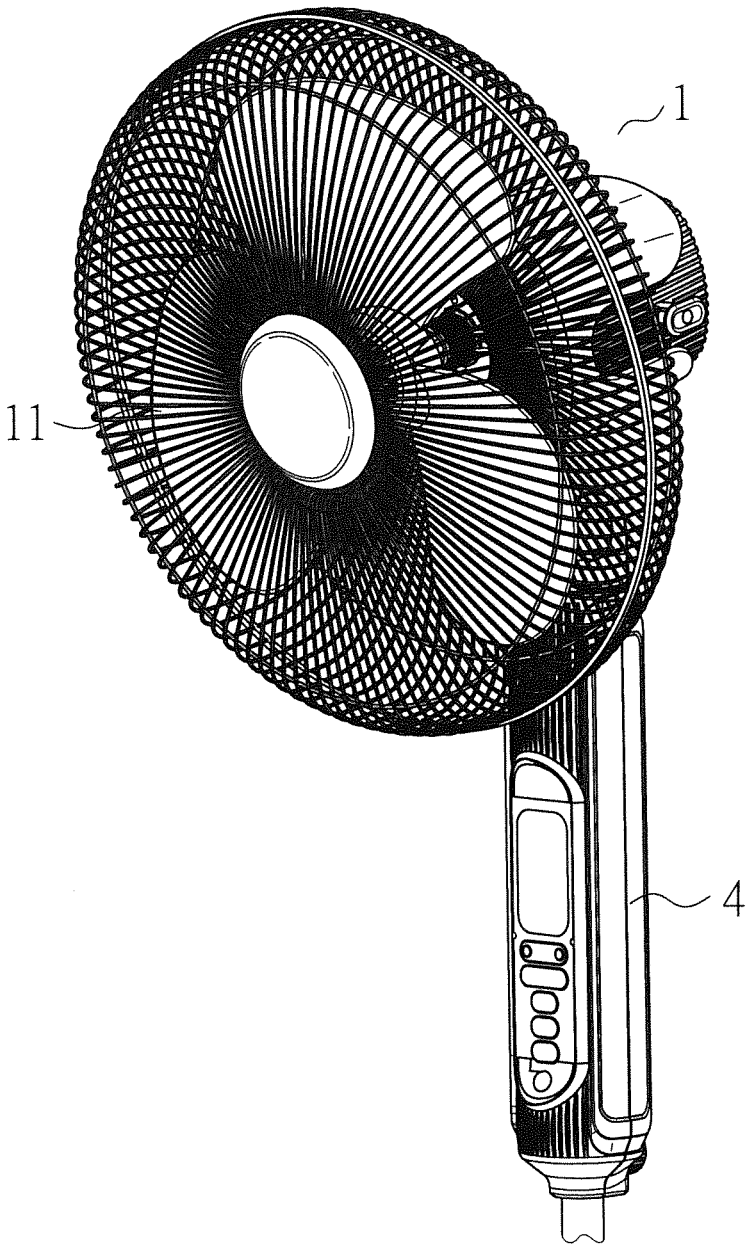
FIG. 5 is a perspective view of the electric fan according to the present invention.

With reference to FIGS. 1 and 5, an electric fan with impediment buffering according to the present invention includes a fan body 1 including a plurality of blades 11 coupled to a fan shaft 12. The fan shaft 12 is coupled to a fan motor 13. The fan body 1 further includes a fan motor bracket 14 connected to a fixing portion 15 of the fan motor 13.

Figure 2:
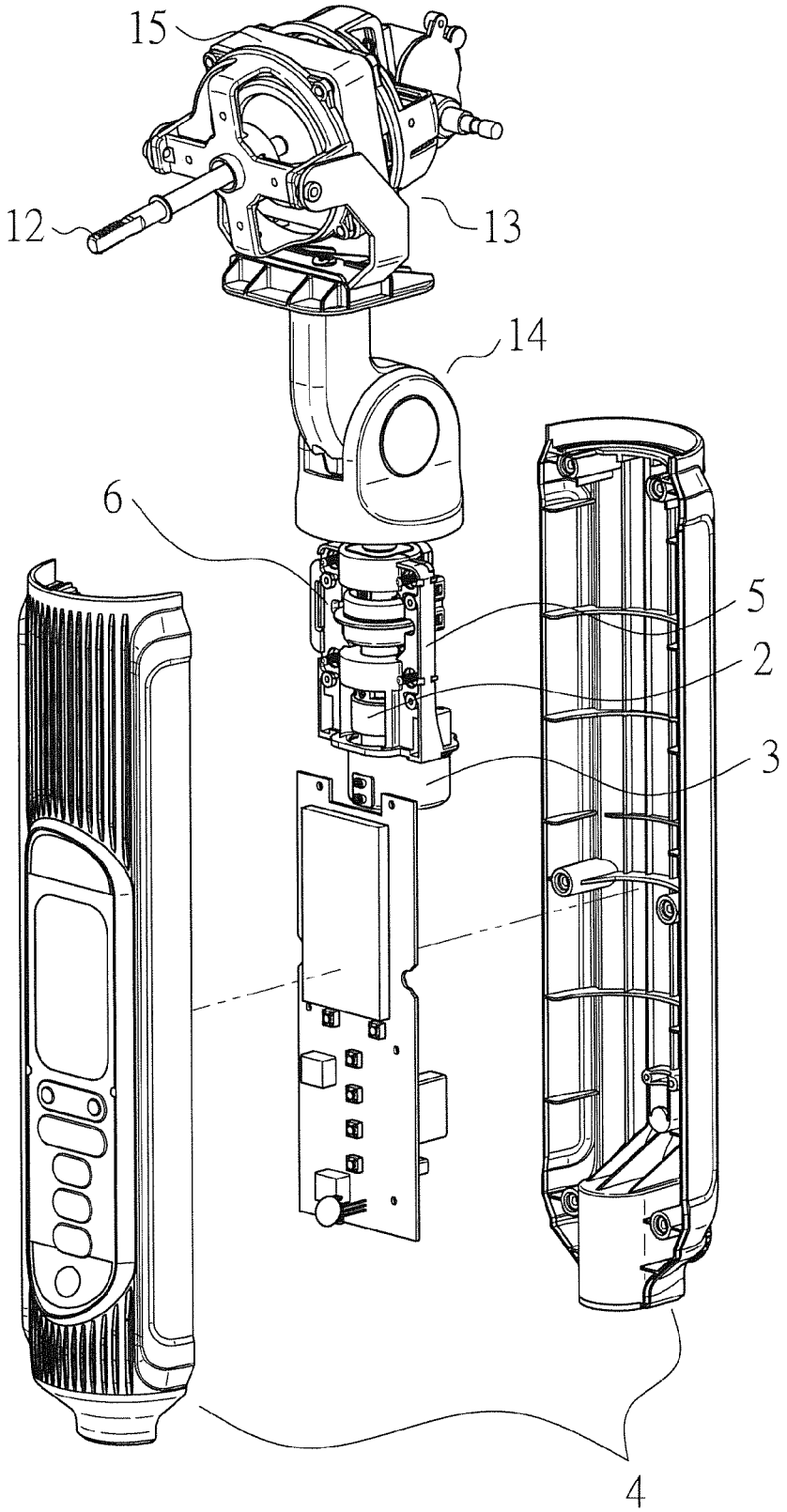
FIG. 2 is a partially exploded perspective view of the electric fan of FIG. 1.

With reference to FIGS. 1 and 2, the electric fan further includes an impediment buffering device 2 including a swivel shaft 21 coupled to the fan motor bracket 14 and a sleeve 22 mounted around the swivel shaft 21. The sleeve 22 is coupled to an output shaft 31 of a swivel motor 3. The sleeve 22 includes an inner periphery having a plurality of pairs of diametrically opposed grooves 221. The swivel shaft 21 receives an elastic element 211 extending in a radial direction of the swivel shaft 21. In the embodiment shown, a ball 212 is mounted to each of two ends of the elastic element 211. The balls 212 are biased by the elastic element 211 to be partially received in a pair of diametrically opposed grooves 221. If desired, a ball 212 can be mounted to only one end of the elastic element 211, and the grooves 221 do not have to be diametrically opposed to each other but can be spaced from each other in a circumferential direction about the swivel shaft 21.

By such an arrangement, during normal swiveling movement of the electric fan, the grooves 221 in the sleeve 22 receive the balls 212, such that the swivel shaft 21 rotates jointly with the sleeve 22. In a case that the fan body 1 is impeded during the swiveling movement, the balls 212 move inward and compress the elastic element 211, disengaging the swivel shaft 21 from the sleeve 22. Thus, damage to the sleeve 22 and the output shaft 31 of the motor 3 can be reduced.

The swivel shaft 21 is connected to the fan motor bracket 14 and can swivel about 360°.

Figure 3:
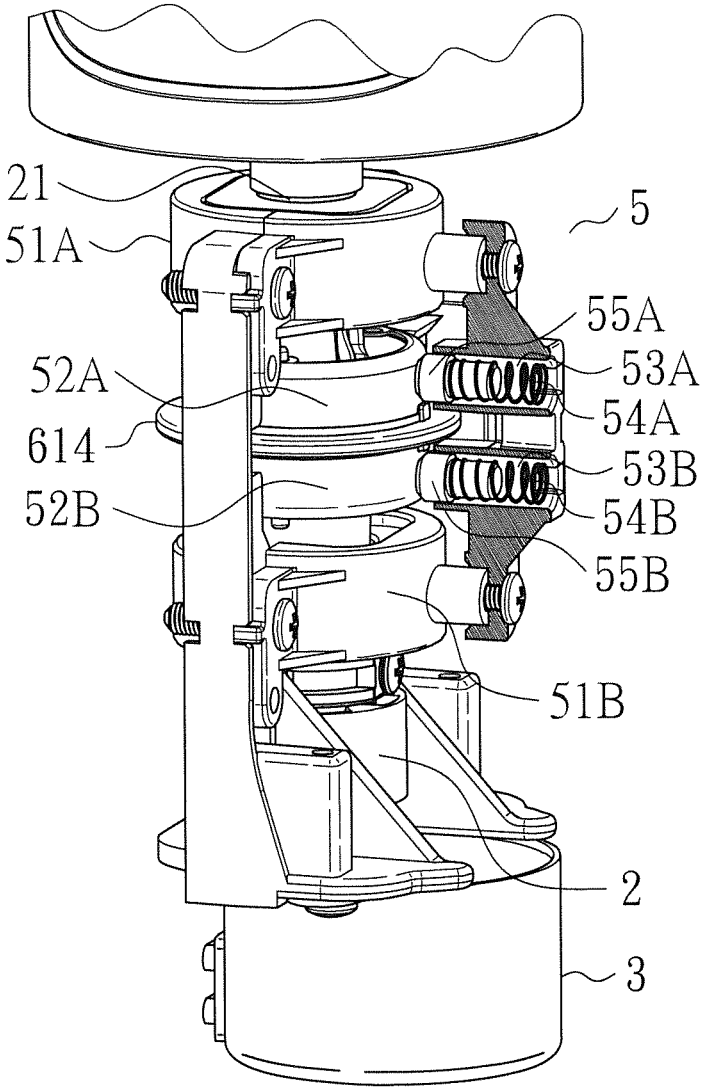
FIG. 3 is an enlarged view of a portion of the electric fan of FIG. 2.
Figure 4:
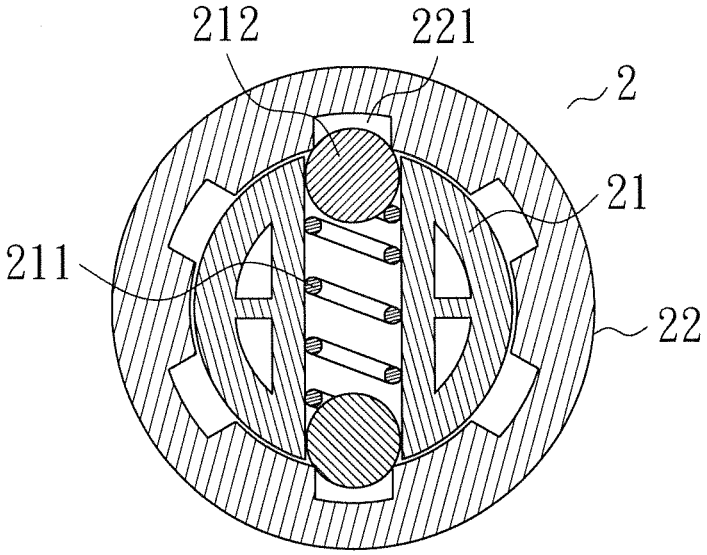
FIG. 4 is a cross sectional view of an impediment buffering device according to the present invention.
Figure 6:
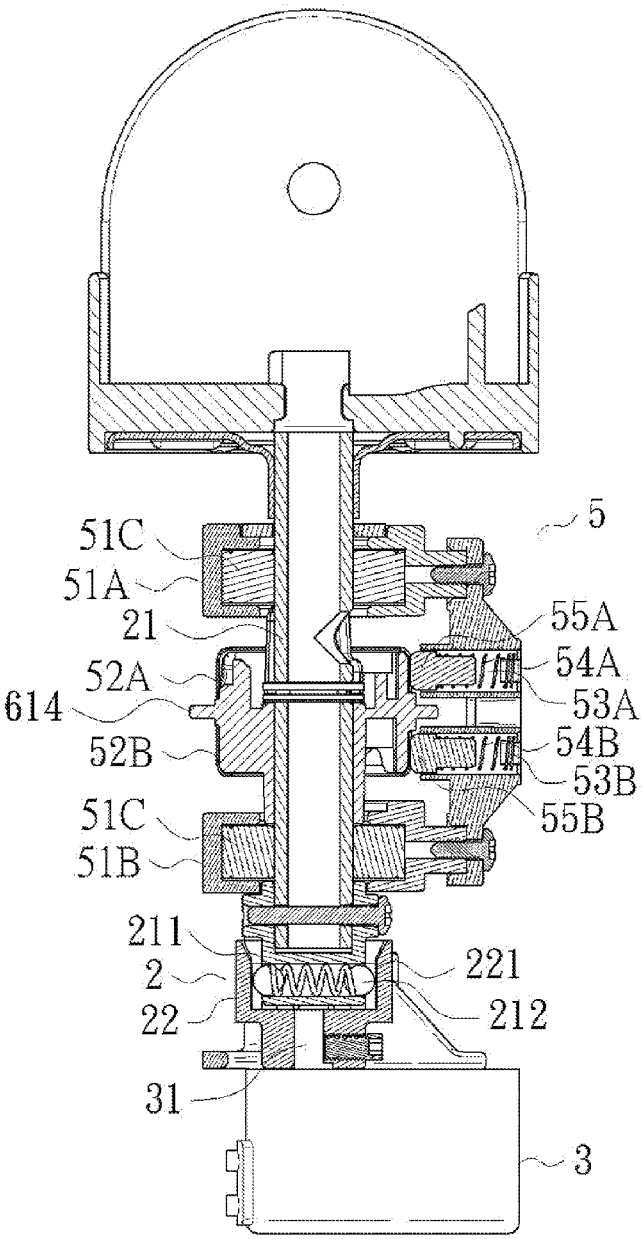
FIG. 6 is a partial, cross sectional view of the electric fan according to the present invention.
Figure 7:
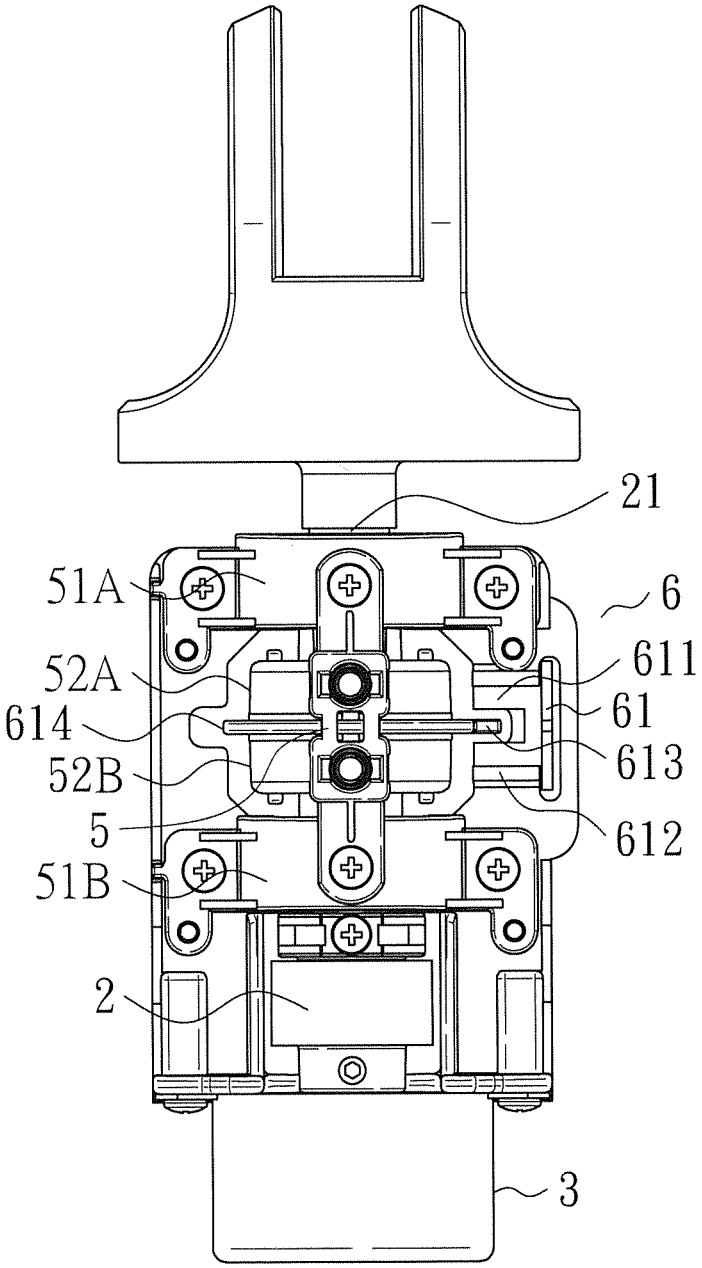
FIG. 7 is a partial, front view of the electric fan according to the present invention.
Figure 8:
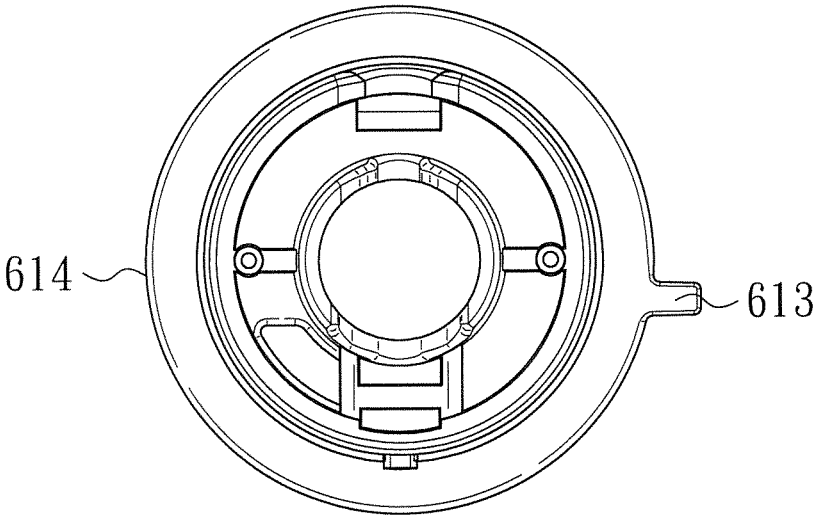
FIG. 8 is a schematic view of a mounting sleeve, a light blocking plate, and a swivel shaft.

With reference to FIGS. 3 and 6, the electric fan can further include a support 5 fixed in relation to the swivel shaft 21. The support 5 includes at least one bearing cap. In the embodiment shown, two bearing caps 51A and 51B are provided and spaced from each other in a vertical direction. Each bearing cap 51A, 51B receives a ball bearing 51C.

To avoid entanglement of power wires (not shown in the drawings) of the fan motor 13 during the swiveling movement of the swivel shaft 21, at least one electrically conductive copper ring is provided. In the embodiment shown, first and second electrically conductive copper rings 52A and 52B are mounted around the swivel shaft 21 and are spaced from each other in the vertical direction. Two tubes 53A and 53B are mounted to the support 5 and are respectively located outside of the first and second electrically conductive copper rings 52A and 52B. Each tube 53A, 53B extends in a radial direction. An electrically conductive spring 54A, 54B is received in each tube 53A, 53B. An electrically conductive bead 55A, 55B is attached to an end of each electrically conductive spring 54A, 54B facing the corresponding first or second electrically conductive copper ring 52A, 52B. When the first and second electrically conductive copper rings 52A and 52B rotate, the electrically conductive beads 55A and 55B are biased by the electrically conductive springs 54A and 54B to with the first and second electrically conductive copper rings 52A and 52B, allowing 360° rotation of the first and second electrically conductive copper rings 52A and 52B. The first and second electrically conductive springs 54A and 54B are adapted to be connected to a power source.

The electric fan can further include an angle limiting switch 6. The angle limiting switch 6 can be of any type of switch capable of detecting the swiveling angle, such as a micro switch (or referred to as "touch switch").

In the embodiment shown, the angle limiting switch 6 includes a detecting circuit board 61. The detecting circuit board 61 includes a transmitter 611 and a receiver 612. The angle limiting switch 6 further includes a mounting frame 614 fixed to the swivel shaft 21. A light blocking plate 613 extends outward from the mounting frame 614 in a radial direction. The detecting circuit board 61 includes a processor (not shown).

When the receiver 612 receives a signal and controls a rotating time of the swivel shaft 21, data in the processor is zeroed when the receiver 612 is blocked by the light blocking plate 613. After a rotating angle of the swivel shaft 21 is set by a user, leftward rotation and rightward rotation on the left and right sides of a zeroed position (e.g., the position of the light blocking plate 613) are controlled by a corresponding rotating time of an average rotating angle on the left and right sides of the zeroed position through data zeroing control.

Specifically, the transmitter 611 and the receiver 612 form a loop. The transmitter 611 sends a signal (such as infrared light), and the receiver receivers the signal (such as infrared light). In a case that the loop between the transmitter 611 and the receiver 612 is blocked by the light blocking plate 613, an instruction code (i.e., time zeroing) is given by the integrated circuit of the detecting circuit board 61. Assume the rotating angle is 180°, the integrated circuit divides 180° by 2, with the two 90° (the average rotating angle) rotating movements on the left and right sides of the light blocking plate 613 (the light blocking plate 613 is the center of the swiveling movement). The rotating angle is converted into time (the rotating time). A working cycle includes leftward swivel movement from the light blocking plate 613 through a predetermined period of time and then back to the light blocking plate 613 and rightward swivel movement from the light blocking plate 613 through the predetermined period of time and then back to the light blocking plate 613.

Although specific embodiments have been illustrated and described, numerous modifications and variations are still possible without departing from the scope of the invention. The scope of the invention is limited by the accompanying claims.

The invention claimed is:

1. An electric fan with impediment buffering, comprising:

a fan body including a plurality of blades coupled to a fan shaft, the fan shaft being coupled to a fan motor and including a fan motor bracket connected to a fixing portion of the fan motor; and an impediment buffering device including a swivel shaft coupled to the fan motor bracket and a sleeve mounted around the swivel shaft, the sleeve being coaxially coupled to an output shaft of a swivel motor, the sleeve including an inner periphery having a plurality of grooves, the swivel shaft receiving an elastic element extending in a radial direction thereon and a ball mounted to an end of the elastic element, the ball being biased by the elastic element to be partially received in one of the plurality of grooves for releasably locking the swivel shaft to the sleeve, wherein the swivel motor remains stationary while the fan motor bracket is driven to undergo swiveling movement relative thereto.

2. The electric fan with impediment buffering as claimed in claim 1, further comprising: a support fixed in relation to the swivel shaft, with the support including a bearing cap receiving a ball bearing, with an electrically conductive copper ring mounted around the swivel shaft, with a tube mounted to the support and extending in a radial direction, with an electrically conductive spring received in the tube, with an electrically conductive bead attached to an end of the electrically conductive spring facing the electrically conductive copper ring, wherein when the electrically conductive copper ring rotates, the electrically conductive bead is biased by the electrically conductive spring to contact the electrically conductive copper ring, allowing 360° rotation of the electrically conductive copper ring, and with the electrically conductive spring adapted to be connected to a power source.

3. The electric fan with impediment buffering as claimed in claim 1, further comprising:

an angle limiting switch including a detecting circuit board, with the detecting circuit board including a transmitter and a receiver, with the angle limiting switch further including a mounting frame fixed to the swivel shaft, with a light blocking plate extending outward from the mounting frame in a radial direction, with the detecting circuit board including a processor, wherein when the receiver receives a signal and controls a rotating time of the swivel shaft, data in the processor is zeroed when the receiver is blocked by the light blocking plate, and wherein after a rotating angle of the swivel shaft is set, leftward rotation and rightward rotation on left and right sides of a zeroed position are controlled by corresponding rotating time of an average rotating angle on the left and right sides of the zeroed position through data zeroing control.

* * * * *